United States Patent [19]

Schaller et al.

[11] Patent Number: 4,964,114

[45] Date of Patent: Oct. 16, 1990

[54] ELECTRODE POSITIONING MECHANISM

[75] Inventors: Hans-Ludwig Schaller; Hans-Joachim Schubert, both of Moers; Ewald Feuerstacke, Dorsten, all of Fed. Rep. of Germany

[73] Assignee: Mannesmann AG, Düsseldorf, Fed. Rep. of Germany

[21] Appl. No.: 358,305

[22] Filed: May 26, 1989

Related U.S. Application Data

[63] Continuation-in-part of PCT DE87/00512, filed on Nov. 10, 1987.

[51] Int. Cl.[5] ..... H05B 7/10

[52] U.S. Cl. ..... 373/94; 373/98

[58] Field of Search ..... 373/98, 99, 94, 52, 373/96, 91–93, 101, 103, 105, 106

[56] References Cited

U.S. PATENT DOCUMENTS

| | | | |
|---|---|---|---|
| 4,295,000 | 10/1981 | Mark . | |
| 4,394,765 | 7/1983 | Reimpell et al. | 373/52 |
| 4,406,008 | 9/1983 | König et al. | 373/102 |
| 4,422,172 | 12/1983 | Dunn et al. | 373/52 |
| 4,422,173 | 12/1983 | Dahlke | 373/94 |
| 4,473,903 | 9/1984 | Bergman et al. | 373/98 |
| 4,481,637 | 11/1984 | Evensen | 373/97 |
| 4,481,638 | 11/1984 | Raquet | 373/98 |
| 4,586,187 | 4/1986 | Hein et al. | 373/106 |
| 4,587,659 | 5/1986 | Ungar et al. | 373/96 |
| 4,615,036 | 9/1986 | Ambrosi et al. | 373/93 |
| 4,646,317 | 2/1987 | Evensen | 373/101 |
| 4,646,318 | 2/1987 | Nordmeyer et al. | 373/105 |
| 4,648,584 | 3/1987 | Wamser | 266/158 |
| 4,670,884 | 6/1987 | Letizia et al. | 373/101 |
| 4,750,188 | 6/1988 | Keonig et al. | 373/96 |

FOREIGN PATENT DOCUMENTS

| | | | |
|---|---|---|---|
| 2750186 | 4/1979 | Fed. Rep. of Germany | 373/98 |
| 2837741 | 3/1980 | Fed. Rep. of Germany . | |
| 2028619 | 3/1980 | United Kingdom | 373/98 |

*Primary Examiner*—Roy N. Envall, Jr.

*Attorney, Agent, or Firm*—Nils H. Ljungman & Associates

[57] ABSTRACT

This invention relates to an electrode positioning mechanism of an electric, electric arc or reduction furnace, in particular for smelting steel, with a guide column, having a mast arm to hold the electrode and guided in a guide frame by front and lateral guide rollers, which are located in a nest, and which can be moved vertically, whereby there are mechanical damping elements to damp mechanical vibrations. To create an electrode positioning mechanism which uses simple means to achieve a vibrational isolation of the individual components of the electrode positioning mechanism, and which reduces the breakage of electrodes in comparison to the devices of the prior art which use complex damping means, the invention proposes that the damping elements 14 be located between the front and lateral guide rollers 6 and the guide frame 7.

19 Claims, 5 Drawing Sheets

ELECTRODE POSITIONING MECHANISM

REFERENCE TO RELATED APPLICATIONS

This application is a continuation-in-part of International Application PCT/DE87/00512 filed on Nov. 10, 1987 designating the U.S. which claims priority from Federal Republic of Germany Patent Application No. P 36 40 298.2 filed on Nov. 26, 1986.

BACKGROUND OF THE INVENTION

1. Field of the Invention:

This invention relates to an electrode positioning mechanism of an electric arc or reduction furnace, in particular for smelting steel. The positioning mechanism includes a guide column having a mast arm to hold the electrode. The guide column is guided in a guide frame and can be moved vertically, by front and lateral guide rollers located in a nest, wherein there are mechanical damping elements to damp mechanical vibrations.

2. Description of the Prior Art: U.S. Pat. No. 4,422,172, incorporated herein by reference, discloses rollers located in a sleeve or nest, which makes possible the vertical movement of an electrode mast arm on a guide column. The guide column and mast arm, however, are vibrationally coupled to one another.

German Laid Open Patent Application No. DE-OS 28 37 741 incorporated herein by reference, discloses an electrode mast arm with a damping element to damp mechanical vibrations. The damping element is located between the mast arm and the electrode or between the mast arm and a point located outside the electrode positioning mechanism. In this prior art apparatus, there is a vibrationally solid coupling between the guide column and the guide frame.

This aforesaid coupling between the column and the frame has the disadvantage that the mass of the guide frame is included in the vibration system, of which the electrode is also a part. A further disadvantage of the coupling is that the individual components of the electrode positioning mechanism can excite one another to vibrations. To damp the system, therefore, high damping forces are required. For this purpose, dampers with large masses and large dimensions are necessary, which make the mast arm structure significantly heavier and larger. In turn, a more powerful drive system is required to raise and lower the mast arm structure.

The same German laid open patent above, discloses hydraulic elements to damp mechanical vibrations, wherein the damping effect is produced in throttles located in hydraulic cylinders. The use of these hydraulic dampers has the disadvantage that the damping action, on one hand, is not particularly effective and, on the other hand, because of the high thermal stresses exerted by the furnace environment, the assembly is subjected to severe fluctuations in its effectiveness. A further disadvantage is that the hydraulic system does not have any return force. Accordingly, the hydraulic elements can be moved by the guide column in one direction only, and the guide column overall is not centered in the guide frame.

One aspect of the invention resides broadly in a electrode positioning apparatus for an electric arc furnace wherein the electrode is supported by a mast arm and guide column and the guide column is supported for vertical movement by guide roll apparatus mounted on a guide frame, the electrode positioning apparatus includes a vibration damping device interposed between the guide roll means and the guide frame.

Another aspect of the invention resides broadly in a vibration damping apparatus for the electrode positioning mechanism of an electric arc furnace, wherein the electrode is supported by mast arm and guide column and the guide column is supported for vertical movement by guide roll means mounted on a guide frame, the vibration damping apparatus includes a vibration damping device interposed between said guide roll apparatus and said guide frame.

OBJECT OF THE INVENTION

The object of the invention is to create an electrode positioning mechanism which uses simple means to achieve a vibrational isolation of the individual components of the electrode positioning mechanism and, thus, to reduce the conventional breakage rate of the electrodes in comparison to the devices of the prior art which have complex damping means.

SUMMARY OF THE INVENTION

This object is achieved in accordance with the invention by means of an electrode positioning mechanism in which the mechanical damping elements are located between the guide roll means and the guide frame.

As a result of the preferred location of the damping elements in a cylindrical recess in each of the nests supporting the front and lateral guide rollers, the guide frame is vibrationally isolated from the electrode mast arm. Moreover, when the furnace has several electrodes, the excitation of the guide columns among themselves by means of the guide frame is eliminated.

The nest, with the front or lateral guide rollers, can be moved transverse to the direction of motion of the guide columns along a retaining bolt which is fastened on the guide frame, so that the guide column is capable of excursions in either direction. The counterpressure is produced by an abutment such as threaded nut, which can be moved on the retaining bolt, and which compresses the damping element by means of a disc also located in the cylindrical recess. Thus a floating mounting of the guide column is achieved, whereby the vibrating mass of the guide frame is decoupled from the vibration system of the electrodes.

The high self-damping of the damping element, with a damping factor between 0.15 and 0.20 (see Mechanical Engineers' Handbook, by Lionel S. Marks, Fifth Edition, Magraw-Hill Book Company, 1951, page 486 et seq.), reduces the resonant frequency of the total system, and shifts it out of the range of the critical excitation frequency.

The damping elements have a high return force, with the effect that the guide column is elastically mounted but simultaneously centered. The application force of the front guide rollers on the guide column can be adjusted by the prestressing of the damping element. The progressive characteristic of the damping element and the constant elastic stop limits the deflection of the guide column for high deflection forces but, for low forces, they allow a sufficient damping distance free.

BRIEF DESCRIPTION OF THE DRAWINGS

One embodiment of the invention is explained in greater detail below, with reference to the accompanying drawing, in which.

DESCRIPTION OF THE PREFERRED EMBODIMENTS

Figure 1:
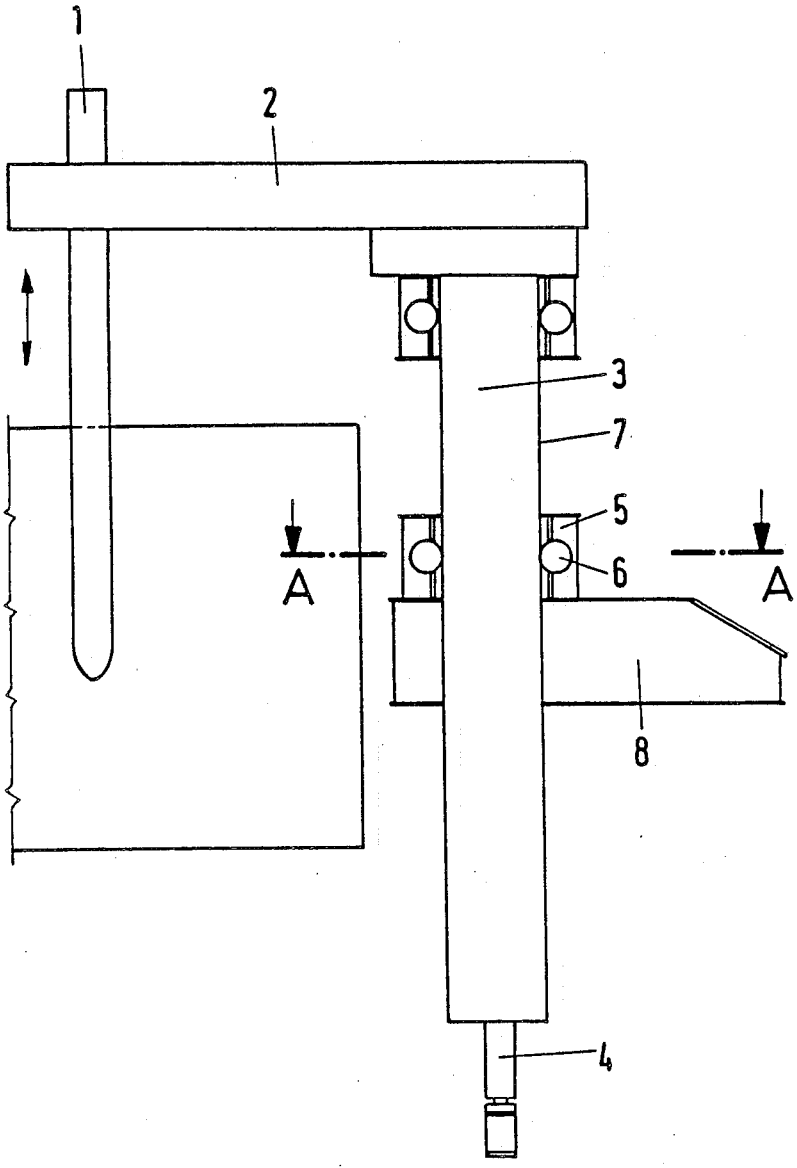
FIG. 1 shows a schematic view of the electrode positioning mechanism.

FIG. 1 is a greatly simplified view of the electrode positioning mechanism. The electrode 1 is moved up and down parallel to the movement of the guide column 3 by means of a mast arm 2. The movement of the guide column is produced hydraulically by means of a regulating cylinder 4, not shown in any detail. The guide column 3 is mounted in a floating fashion by means of front and lateral guide rollers 6 which are located in the nests 5. The nests 5 are located in the guide frame 7 and the guide frame 7 is fastened to the portal platform 8.

Figure 2:
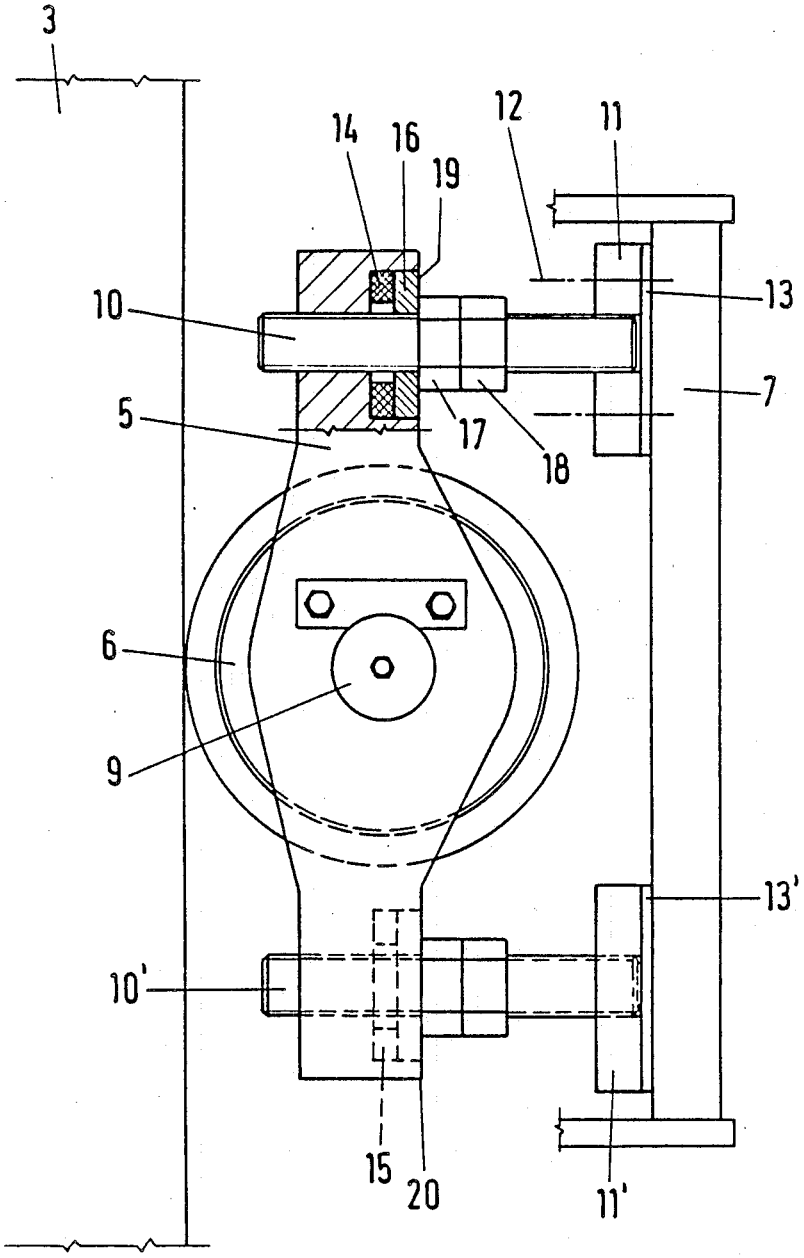
FIG. 2 shows typical details of both the front and lateral guide rollers.
Figure 4:
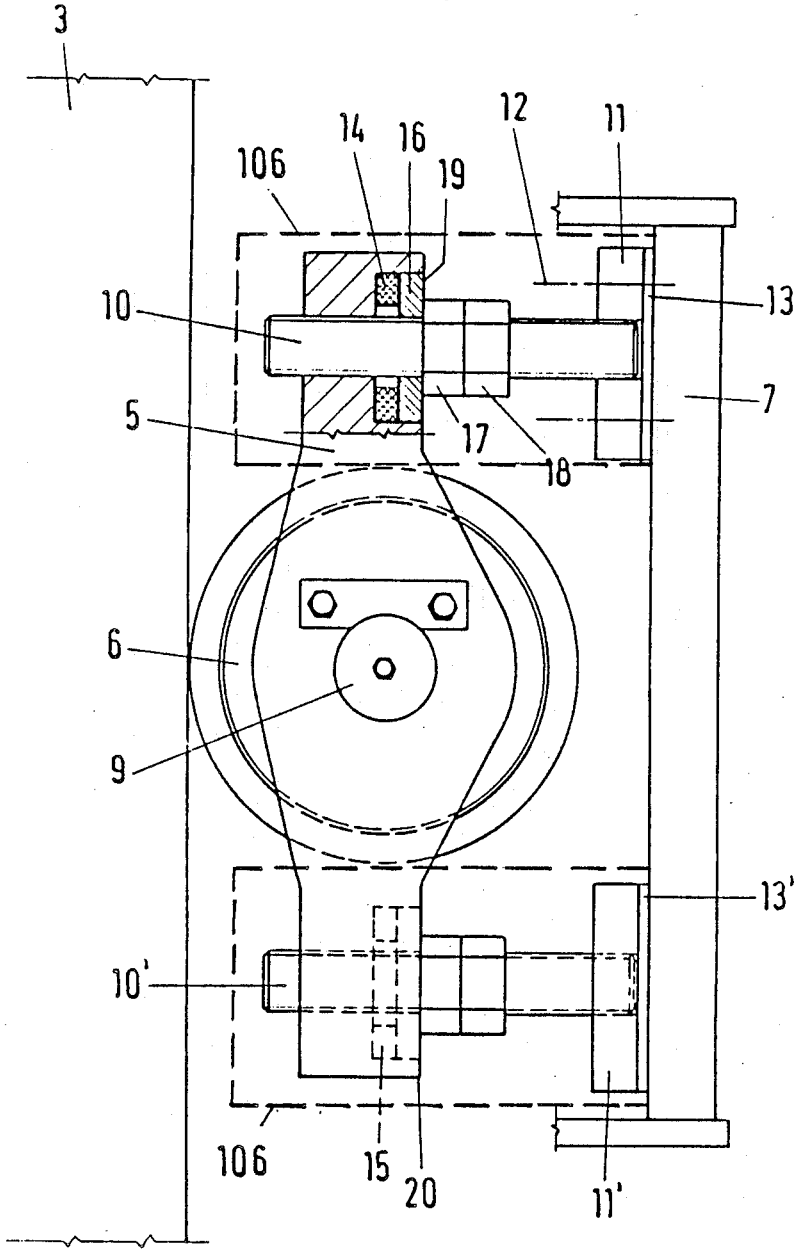
FIG. 4 is a view like FIG. 2 further pointing out the dampening mechanism of the invention.

FIGS. 2 and 4 show details of the front and lateral guide rollers 6 that are shown schematically in FIG. 1. The front and lateral guide rollers 6 are able to rotate on bearings (not shown here) on a shaft or pivot 9, which is braced or supported in a hole or aperature in the middle of the nest 5. The nest 5 can be moved on two retaining bolts 10, 10' which have threads. The retaining bolts 10, 10' are welded to plates 11, 11', which are attached to the guide frame 7 by means of screws (not shown) at locations 12. There are advantageously shims or adjustment straps 13, 13' between the plates 11, 11' and the guide frame 7. The damping element 14 is located in a cylindrical hole 15 in the nest 5, and the application disc 16 is located in the same hole. The nut 17 bolted onto the retaining bolt 10 presses the disc 16 against the damping element 14, so that a specified prestress is produced in the latter. To make certain that this prestress is produced, the depth of the cylindrical recess 15, the thickness of the damping element 14 and the thickness of the disc 16 will be selected so that after the nut 17 is turned, the outer surface 19 of the disc 16 facing the nut will lie in a line with the external contour 20 of the nest 5. To prevent the nut 17 from turning, a lock nut 18 is screwed onto the same retaining bolt 10.

Figure 3:
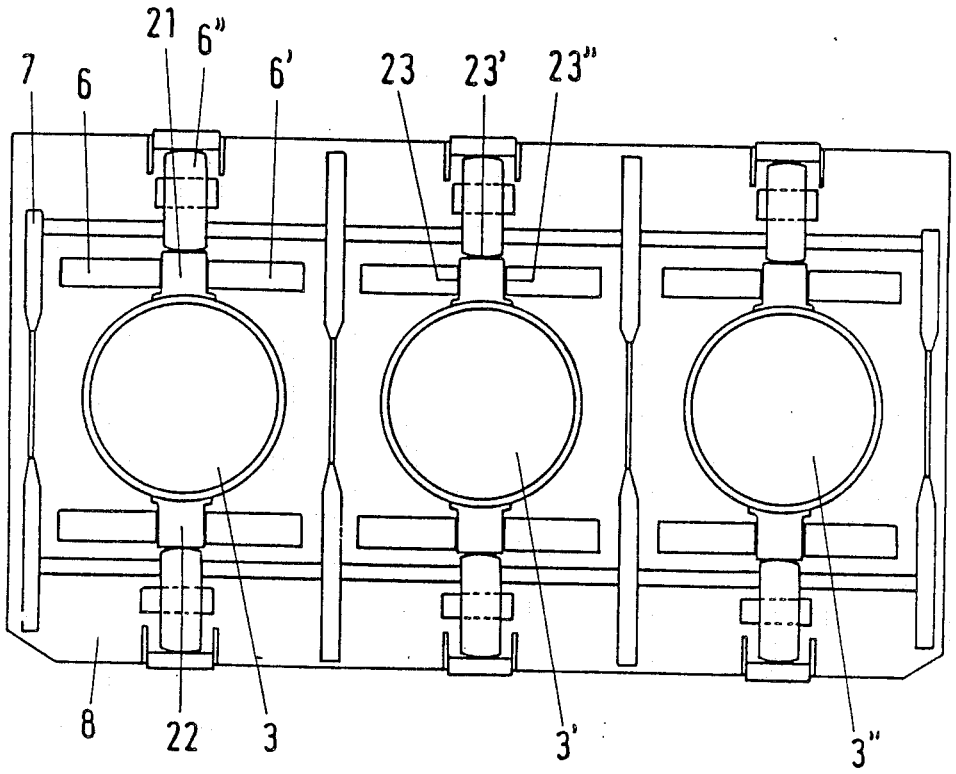
FIG. 3 shows a section through the guide column along Line A—A of FIG. 1.
Figure 5:
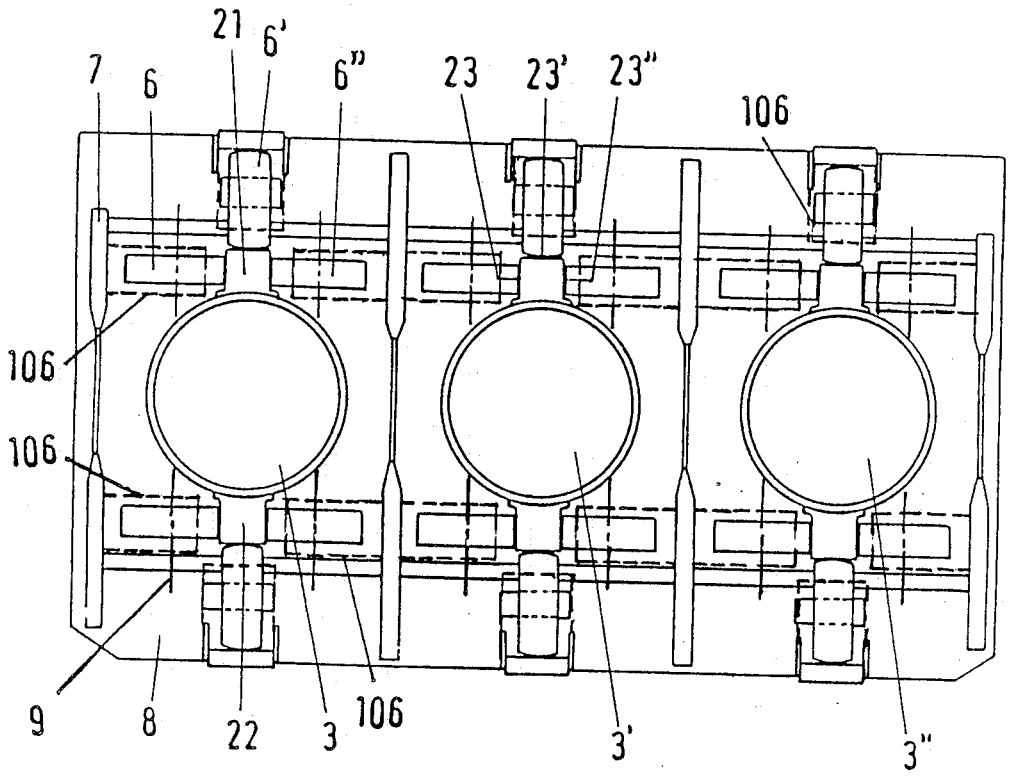
FIG. 5 is a view like FIG. 3 showing schematically typical positioning of the damping mechanism of the invention relative to the front and lateral guide rolls.

FIGS. 3 and 5 show a cross section along Line A—A in FIG. 1. In this furnace, which is operated with three electrodes, the corresponding three guide columns 3, 3', 3'' are arranged in a row. Fastened on both sides of the guide columns 3, 3', 3'' there are webs 21, 22, with which the lateral guide rollers 6, 6' and the front guide roller 6'' are in contact with their contact surfaces 23, 23' and 23'' respectively. These webs 21, 22 can easily be replaced if wear occurs, and they prevent the guide columns 3, 3', 3'' from twisting.

In FIG. 4, the support nest and damping elements 5 and 10 thru 20 are shown included in dash-line block 106. In FIG. 5, blocks 106 shown schematically the typical positioning of the nest support and damping mechanism of the invention relative to the front and lateral guide rolls of the electrode furnace illustrated therein.

In summing up, one aspect of the invention resides in an electrode positioning mechanism for an electric arc or reduction furnace, in particular an electric furnace for smelting steel. A guide column, having a mast arm to hold the electrode is guided vertically in a guide frame by front and lateral guide rollers. The rollers are located in a nest, and there are mechanical damping elements to damp mechanical vibrations. Preferably, the damping elements are located between the front and lateral guide rollers and the guide frame.

Another aspect of the invention resides in an electrode positioning mechanism in which each nest supports the front and lateral guide rollers and has at least one damping element.

Yet another aspect of the invention resides in an electrode positioning mechanism wherein the nest can move transverse to the direction of movement of the guide column along a retaining bolt which is fastened to the guide frame and the nest has a hole with a cylindrical recess in which the damping element is located and the retaining bolt passes through the hole and the damping element.

A further aspect of the invention resides in an electrode positioning mechanism wherein, for the prestressing of the damping element, there is an adjustable abutment on the retaining bolt.

A yet further aspect of the invention resides in an electrode positioning mechanism wherein, the damping element has a high self-damping with a damping factor of 0.15–0.20.

The invention as described hereinabove in the context of a preferred embodiment is not to be taken as limited to all of the provided details thereof, since modifications and variations thereof may be made without departing from the spirit and scope of the invention.

What is claimed is:

1. Electrode positioning apparatus for an electric arc furnace wherein the electrode is supported by a mast arm and guide column and the guide column is supported for vertical movement by guide roll means mounted on a guide frame, said electrode positioning apparatus comprising:

vibration damping means interposed between said guide roll means and said guide frame;

said vibration damping means being configured to vibrationally decouple said guide frame and the electrode.

2. Electrode positioning apparatus according to claim 1, wherein said guide roll means is supported in a nest affixed to said guide frame.

3. Electrode positioning apparatus according to claim 2, wherein guide roll means are positioned on opposite sides of said guide column.

4. Electrode positioning apparatus according to claim 3, in which said guide roll means includes both front and lateral guide rolls.

5. Electrode positioning apparatus according to claim 4, wherein each nest supporting front and lateral guide rolls has at least one damping element comprising said damping means.

6. Electrode positioning apparatus according to claim 5, wherein each nest is constructed and arranged to move transverse to the direction of movement of said guide column along a retaining member which is fastened to said guide frame and each nest has an aperature with a cylindrical recess in which said damping element is located, such that said retaining member passes through said aperature and said damping element.

7. Electrode positioning apparatus according to claim 6, which includes an adjustable abutment member on said retaining member for positioning said damping element.

8. Electrode positioning apparatus according to claim 7, wherein said retaining member comprises a threaded bolt and said abutment member comprises a threaded nut.

9. Electrode positioning apparatus according to claim 1, wherein said damping means has high self-damping with a damping factor of 0.15–0.20.

10. Electrode positioning apparatus according to claim 9, wherein said damping means has a progressive characteristic which is parabolic at the beginning and then runs toward a limit value comprising a constant elastic stop.

11. Vibration damping apparatus for the electrode positioning mechanism of an electric arc furnace, wherein the electrode is supported by a mast arm and guide column and the guide column is supported for vertical movement by guide roll means mounted on a guide frame, said vibration damping apparatus comprising:

vibration damping means interposed between said guide roll means and said guide frame;

said vibration damping means being configured to vibrationally decouple said guide frame and the electrode.

12. Vibration damping apparatus according to claim 11, wherein said guide roll means is supported in a nest constructed and arranged to move transverse to the direction of movement of said guide column along a retaining member which is fastened to said guide frame and said nest has an aperature with a cylindrical recess in which said vibration damping means is located, such that said retaining member passes through said aperature and said damping means.

13. Vibration damping apparatus according to claim 12, which includes an adjustable abutment member on said retaining member for prestressing said damping means.

14. Vibration damping apparatus according to claim 13, wherein guide roll means are positioned on opposite side of said guide column.

15. Vibration damping apparatus according to claim 14, in which said guide roll means includes both front and lateral guide rolls.

16. Vibration damping apparatus according to claim 15, wherein each nest supporting front and lateral guide rolls has at least one damping element comprising said damping means.

17. Vibration damping apparatus according to claim 13, wherein said retaining member comprises a threaded bolt and said abutment member comprises a threaded nut.

18. Vibration damping apparatus according to claim 13, wherein said damping means has high self-damping with a damping factor of 0.15 to 0.20.

19. Vibration damping apparatus according to claim 13, wherein said damping means has a progressive characteristic which is parabolic at the beginning and then runs toward a limit value comprising a constant elastic stop.

* * * * *

UNITED STATES PATENT AND TRADEMARK OFFICE

CERTIFICATE OF CORRECTION

PATENT NO. : 4,964,114

DATED : October 16, 1990

INVENTOR(S) : Hans-Ludwig SCHALLER, et al.

It is certified that error appears in the above-identified patent and that said Letters Patent is hereby corrected as shown below:

On the title page after item (22), and before the INID code section [63], please insert a new INID code section [30].

--[30] Foreign Application Priority Data
November 26, 1986 [DE] Fed. Rep. of Germany 3640298.2--

Signed and Sealed this

Twelfth Day of May, 1992

*Attest:*

DOUGLAS B. COMER

*Attesting Officer*

*Acting Commissioner of Patents and Trademarks*